US008495788B2

(12) United States Patent
Tran

(10) Patent No.: US 8,495,788 B2
(45) Date of Patent: Jul. 30, 2013

(54) FILTER LOCKING ARRANGEMENT FOR A VACUUM CLEANER

(75) Inventor: Phong H. Tran, Caledonia, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 574 days.

(21) Appl. No.: 12/724,956

(22) Filed: Mar. 16, 2010

(65) Prior Publication Data

US 2010/0236016 A1 Sep. 23, 2010

Related U.S. Application Data

(60) Provisional application No. 61/161,926, filed on Mar. 20, 2009.

(51) Int. Cl.
*A47L 13/10* (2006.01)

(52) U.S. Cl.
USPC ..... 15/327.6; 15/372.2; 55/DIG. 3

(58) Field of Classification Search
USPC ..... 15/327.1, 327.2, 327.6, 350–353, 15/347; 55/337, DIG. 2, DIG. 3
See application file for complete search history.

(56) References Cited

U.S. PATENT DOCUMENTS

| | | | | |
|---|---|---|---|---|
| 6,385,810 | B1 | 5/2002 | Lang | |
| 6,829,805 | B2 | 12/2004 | Yang | |
| 6,868,579 | B2 | 3/2005 | Yang | |
| 2002/0088079 | A1 | 7/2002 | Oh | |
| 2007/0084158 | A1 | 4/2007 | Fester | |
| 2007/0251048 | A1 | 11/2007 | Choi | |
| 2010/0071152 | A1 * | 3/2010 | Cho et al. | 15/347 |

FOREIGN PATENT DOCUMENTS

| | | | |
|---|---|---|---|
| EP | 1642521 | A2 | 4/2006 |
| GB | 1158118 | A | 7/1969 |

* cited by examiner

*Primary Examiner* — William Gilbert
(74) *Attorney, Agent, or Firm* — McGarry Bair PC

(57) ABSTRACT

A vacuum cleaner has an improved filter locking arrangement. A locking tab protrudes upwardly from a motor housing. The tab is received within an aligned slot in the filter housing and extends into a pocket formed in the filter frame. The tab prevents the filter frame from being rotated with respect to the filter housing and the motor housing while the filter housing is mounted to the main housing.

20 Claims, 4 Drawing Sheets

FILTER LOCKING ARRANGEMENT FOR A VACUUM CLEANER

CROSS-REFERENCE TO RELATED APPLICATION

This application claims the benefit of U.S. Provisional Patent Application No. 61/161,926, filed on Mar. 20, 2009, which is incorporated herein by reference in its entirety.

BACKGROUND OF THE INVENTION

1. Field of the Invention

The invention relates to vacuum cleaners having cyclonic separation systems, and in particular to a debris collection container and filter housing removable from a main housing. In one of its aspects, the invention relates to a bottom discharge debris collection container removable from a main housing independent of a filter housing. In another of its aspects, the invention relates to a filter housing associated with a filter assembly where the filter housing is jointly removable from the main housing together with the filter assembly. In yet another of its aspects, the invention relates to an interlock for a vacuum cleaner to prevent removal of the filter assembly from the filter housing while the filter housing is mounted to the main housing.

2. Description of the Related Art

Vacuum cleaners employing cyclone separators are well-known in the art. Cyclone separator designs commonly employ frusto-conical shaped separators, while others use high-speed rotational motion of the air/dirt in a cylindrical separator to separate the dirt by centrifugal force. Typically, working air enters and exits at an upper portion of the cyclone separator while the bottom portion of the cyclone separator is used to collect debris. It is further known to employ multiple serial cyclone separators to improve the collection of fine debris particles that may not be collected by a single separator. Furthermore, in an effort to reduce weight, the motor/fan assembly that creates the working air flow is typically placed at the bottom of the handle, below the cyclone separator. This arrangement therefore, requires a tortuous air path from the top of the cyclone assembly, down the handle to the inlet of the motor/fan assembly. This creates a long air path with multiple parts which may allow for air leaks and generally negatively impacting airflow and, necessarily, cleaning performance.

BISSELL Homecare, Inc. presently manufactures and sells in the United States a vacuum cleaner with cyclonic dirt separation and a bottom discharge debris collection container. The debris collection container is located beneath the cyclone separator and further has a filter located beneath the debris collection container and between the debris collection container and a suction motor inlet. The air flowing through the cyclone separator passes through an annular cylindrical cage to a hollow standpipe that extends through the debris collection container and to a filter housing that is in communication with the suction motor inlet. A filter secured within the filter housing removes fine particles in the airstream that passes from the cyclone separator to the suction motor inlet. The filter housing is connected to the debris collection container whereby both the debris collection container and the filter housing are selectively removable together from the main housing. The cyclone separator, debris collection container, and filter are further disclosed in U.S. Application Publication No. 20070084158, which is incorporated herein by reference in its entirety.

To ensure efficient operation of a vacuum cleaner, clogged filters must be cleaned or replaced periodically. Configuring a debris collection container and filter housing to be separately removable from a main housing can increase the visibility of a pre-motor filter assembly to an end user. Increased visibility, in turn, can lead to a higher probability of adequate filter maintenance. With the increased chance of filter removal for replacement or cleaning, however, the risk of inadvertent vacuum cleaner operation without a pre-motor filter also increases. This is undesirable because any fine dust remaining in the working airstream can be ingested by the fan/motor assembly and can lead to premature fan/motor wear or failure. Therefore, it is desirable to implement a design that alleviates this concern by preventing filter removal while the filter housing is mounted to the main housing.

U.S. Pat. No. 6,829,805 to Yang discloses a canister vacuum cleaner that has an exhaust filter cover that can be locked to one side of the main body of a vacuum cleaner. A filter is locked within the filter cover in a bayonet-style mounting arrangement. The outer peripheral surface of the filter is fitted into a mounting ring of the filter cover, and the filter is rotated to bring protrusions formed thereon into engagement with grooves on the filter cover.

U.S. Pat. No. 6,868,579 to Yang discloses a canister vacuum cleaner that has an exhaust filter cover that can be locked to a motor housing of the vacuum cleaner. The locking arrangement comprises protrusions that protrude radially inwardly from an inner end of the filter cover and that are received by grooves on the motor housing and locked therein by rotation of the filter cover relative to the motor housing.

SUMMARY OF THE INVENTION

A vacuum cleaner according to the invention comprises a main housing having a suction cavity and a motor housing, a dirt separator removably mounted in the suction cavity and having a separation chamber with an inlet opening and an outlet opening, a vacuum fan/motor mounted in the motor housing of the main housing and having a suction inlet in communication with the dirt separator outlet opening and adapted to maintain a flow of dirty air through the separation chamber between the inlet opening and the outlet opening, a filter housing removably mounted in the main housing between the dirt separator and the suction inlet of the vacuum fan/motor, and a filter assembly removably mounted in the filter housing. There is an interlock between the filter assembly, the filter housing, and the main housing to prevent removal of the filter assembly from the filter housing prior to removal of the filter housing from the main housing. In one embodiment, the dirt separator can be a cyclonic dirt separator. In another embodiment, the dirt separator can be a bag filter.

In another embodiment, the interlock comprises a locking rib associated with the motor housing and configured to be selectively received in a corresponding slot in the filter housing when the filter housing is adjacent the motor housing and coupled to a portion of the filter assembly to prevent removal of the filter assembly when the filter housing is seated in the main housing.

In yet another embodiment, the vacuum cleaner further comprises a debris collection container removably coupled to the separation chamber and adapted to receive debris separated from air in the separation chamber. The vacuum cleaner can further comprise a debris inlet at an upper portion of the separation chamber through which debris can enter the debris collection container. The vacuum cleaner can further comprise a cam mechanism beneath the filter housing for raising and lowering the filter housing and the debris collection container with respect to the separation chamber whereby the debris collection container is in a first position in contact with the separation chamber and in a second position separated from the separation chamber for removal of the debris collection container. The debris collection container can also be removably mounted to the main housing independent of the filter housing and the debris collection container is directly adjacent the filter housing and the filter assembly is configured within the filter housing so that the filter assembly is exposed for removal when the debris collection container is removed from the main housing.

In yet another embodiment, the filter assembly is configured to be fastened to a bottom wall of the filter housing via an interlock. The interlock can be a rotational connection, such as a ¼ turn bayonet fastener, or a threaded fastener. The filter assembly can comprise a filter frame that includes at least one recessed pocket and a cavity that receives a filter, and wherein the main housing comprises at least one locking rib that is adapted to be removably retained in the recessed pocket. The at least one locking rib can be a cylindrical post or a T-shaped rib. The recessed pocket and locking rib can comprise an interlocking connection that is adapted to retain the filter assembly in the filter housing when the filter assembly and filter housing are mounted in the main housing. The filter housing can comprise a slot through which the locking rib may extend when the filter assembly is fastened to the filter housing. The locking rib interfaces with the filter assembly and the motor housing to prevent rotation of the filter assembly with respect to the filter housing so that a user must remove the filter housing from the main housing prior to removal of the filter assembly.

A vacuum cleaner according to another embodiment of the invention comprises a main housing having a suction cavity and a motor housing, a dirt separator removably mounted in the main housing, a vacuum fan/motor mounted in the motor housing of the main housing and having a suction inlet in communication with the dirt separator and adapted to maintain a flow of dirty air through the dirt separator, a filter housing removably mounted in the main housing between the dirt separator and the suction inlet of the vacuum fan/motor, and a filter assembly removably mounted in the filter housing. The dirt separator is removable from the main housing independent of the filter housing and the dirt separator is directly adjacent the filter housing and the filter assembly is configured within the filter housing so that the filter assembly is visible to a user when the dirt separator is removed from the main housing.

In one embodiment, the dirt separator is a cyclonic dirt separator. The cyclonic dirt separator comprises a separation chamber having an inlet opening and an outlet opening and a debris collection container removably coupled to the separation chamber and adapted to receive debris separated from air in the separation chamber.

In yet another embodiment, an interlock between the filter assembly, the filter housing, and the main housing is configured to prevent removal of the filter assembly from the filter housing prior to removal of the filter housing from the main housing. Further, the interlock comprises a locking rib associated with the motor housing and configured to be selectively received in a corresponding slot in the filter housing when the filter housing is positioned adjacent the motor housing and coupled to a portion of the filter assembly to prevent removal of the filter assembly when the filter housing is seated in the main housing.

DESCRIPTION OF THE PREFERRED EMBODIMENT

Figure 1:
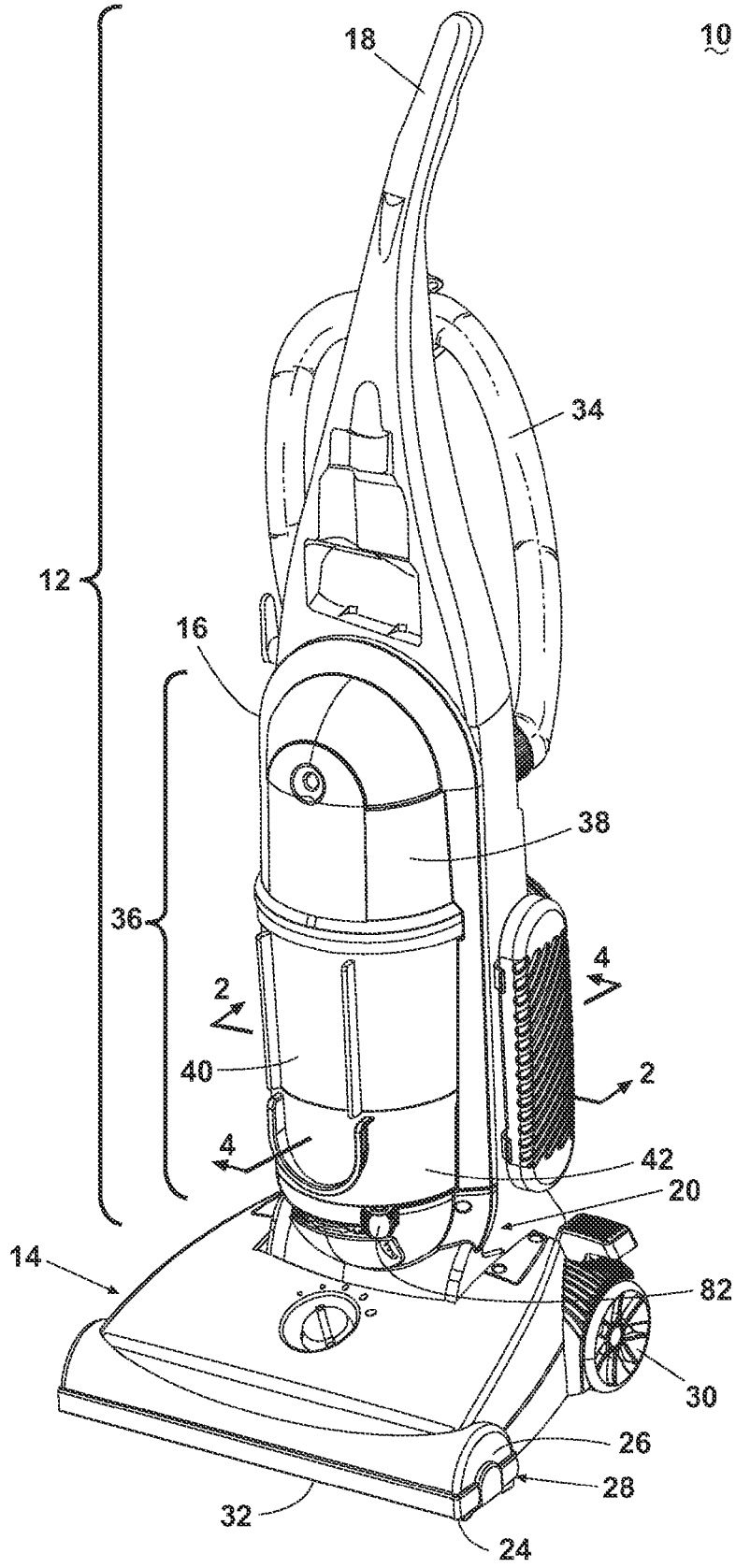
FIG. 1 is a perspective view of a vacuum cleaner with filter locking arrangement according to the invention.
Figure 2:
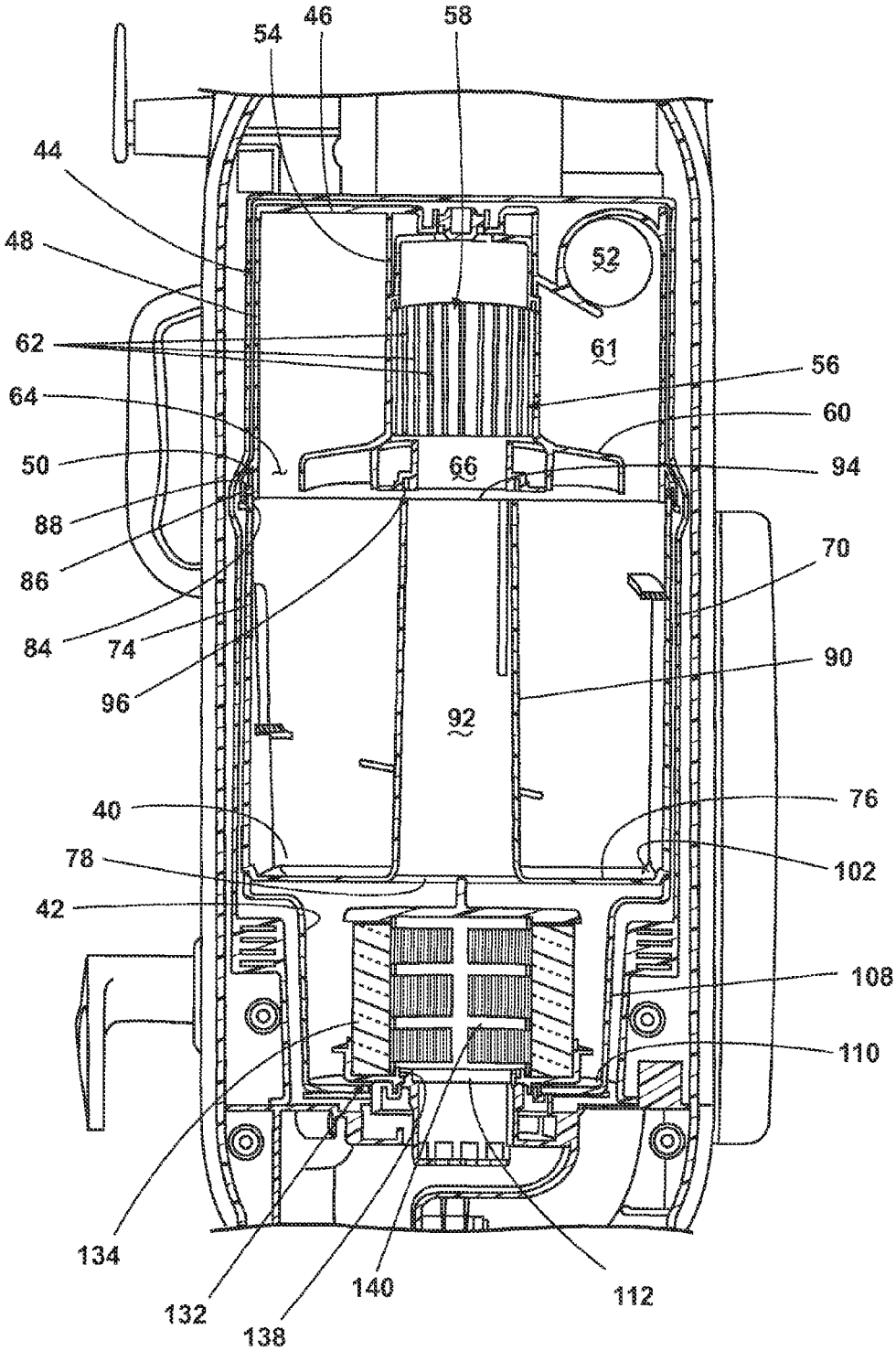
FIG. 2 is a partial cross-sectional view taken along line 2-2 of FIG. 1.

Referring to FIGS. 1-2, a vacuum cleaner 10 comprises a handle assembly 12 pivotally mounted to a cleaning foot assembly 14. The handle assembly 12 comprises a main housing 16 with a handgrip 18 at one end to facilitate movement by a user across a surface to be cleaned. A motor cavity 20 is formed at an opposite end of the main housing 16 and contains a conventional fan/motor assembly 22 (FIG. 4) oriented transversely therein. The handle assembly 12 pivots relative to the foot assembly 14 through an axis formed relative to a shaft within the fan/motor assembly 22.

The foot assembly 14 comprises a lower housing 24 that mates with an upper housing 26 to form a brush chamber 28 in a forward portion thereof. A rotating brush roll assembly (not shown) is positioned within the brush chamber 28. A pair of rear wheels 30 is secured to a rearward portion of the foot assembly 14, rearward being defined relative to the brush chamber 28. It is contemplated that a variety of foot assemblies 14 can be interchanged with the handle assembly 12 and other possible foot assembly configurations can be utilized.

An inlet port of the main housing is formed by a suction nozzle 32 formed beneath a forward portion of the foot assembly 14 below the brush chamber 28. The suction nozzle 32 is in fluid communication with the surface to be cleaned. A foot conduit (not shown) provides an air path from the suction nozzle 32 through the foot assembly 14 to a hose 34 or duct that is connected to an inlet aperture of a dirt separator. The dirt separator can be a conventional clean air vacuum bag filter or a cyclonic dirt separator.

In one embodiment, a cyclone module 36 is received within a suction cavity (not shown) of the main housing 16. The cyclone module 36 comprises a cyclonic dirt separator 38, a debris collection container 40, and pre-motor filter chamber 42. The debris collection container 40 and filter chamber 42 are removably connected to the main housing 16 and configured to be vertically adjustable relative to the cyclonic dirt separator 38.

The cyclonic dirt separator 38 comprises a cylindrical separator housing 44 having an upper wall 46 and a sidewall 48, the sidewall 48 terminating in an offset lower lip 50. The sidewall 48 further includes a tangential inlet 52 at an upper portion for generating a tangential airflow within the cyclonic dirt separator 38. A cylindrical collar 54 depends from the upper wall 46 of the separator housing 44 and receives an exhaust grill 56. The exhaust grill 56 comprises a hollow cylindrical louver cage 58 mounted on a separator plate 60. The louver cage 58 and separator plate 60 are removably mounted on the cylindrical collar 54 on the upper wall 46 of the separator housing 44 via a quarter turn bayonet fastener arrangement. However, other fastening means can be used to removably mount the exhaust grill 56 to the upper wall 46 such as threads, detents, or other commonly known fastening methods. The louver cage 58 comprises a plurality of louvers 62 cylindrically arranged between a top portion of the louver cage 58 and the separator plate 60. Alternatively, a perforated cylindrical grille is also suitable. A separation chamber 61 is defined between the sidewall 48 and the louver cage 58. A debris outlet 64 is formed by a gap between the separator plate 60 and the sidewall 48. A working air path is defined through the louver cage 58 and through a central outlet aperture 66 in the separator plate 60.

Figure 3:
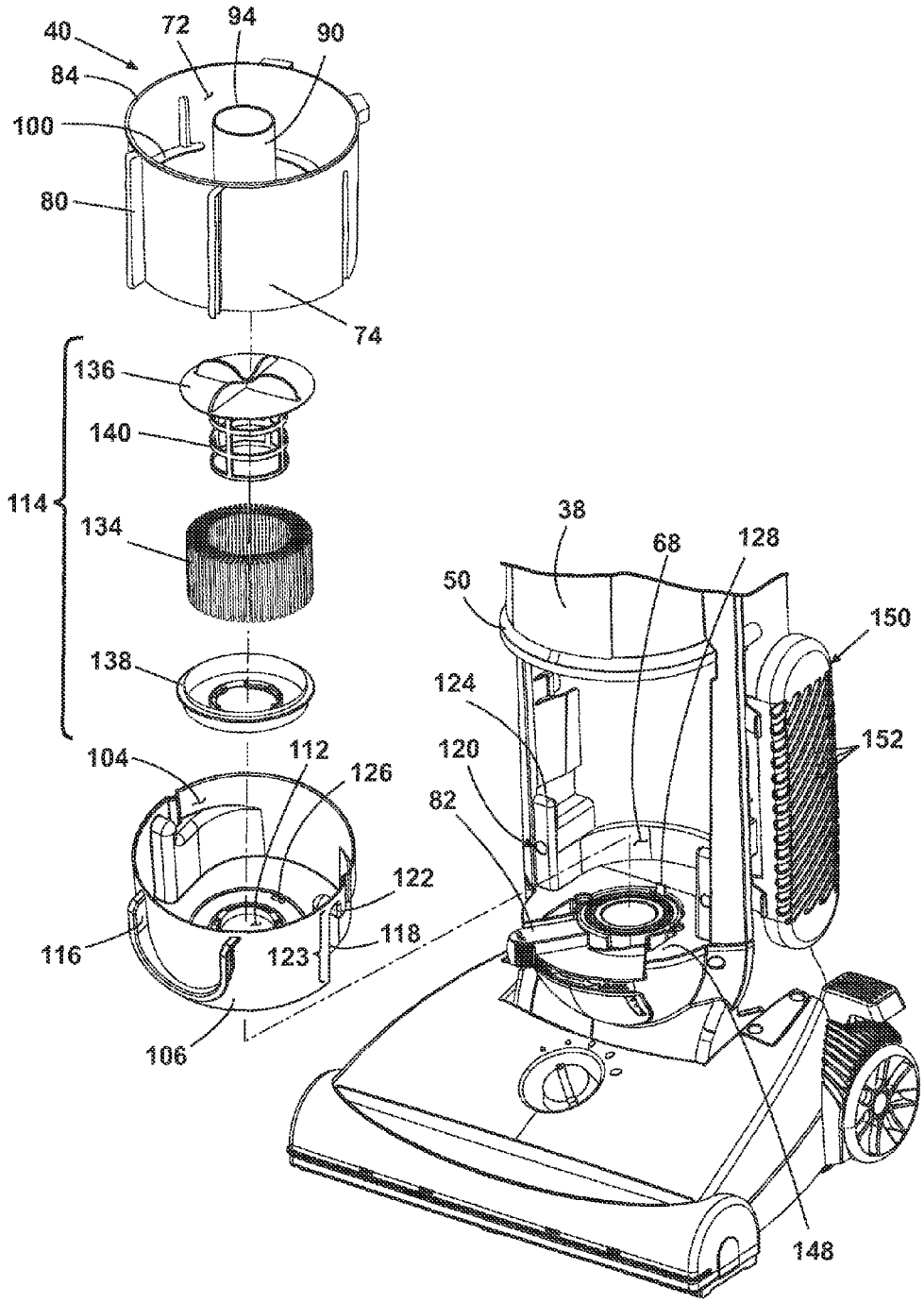
FIG. 3 is a partial exploded perspective view of the cyclone module and vacuum cleaner of FIG. 1.
Figure 4:
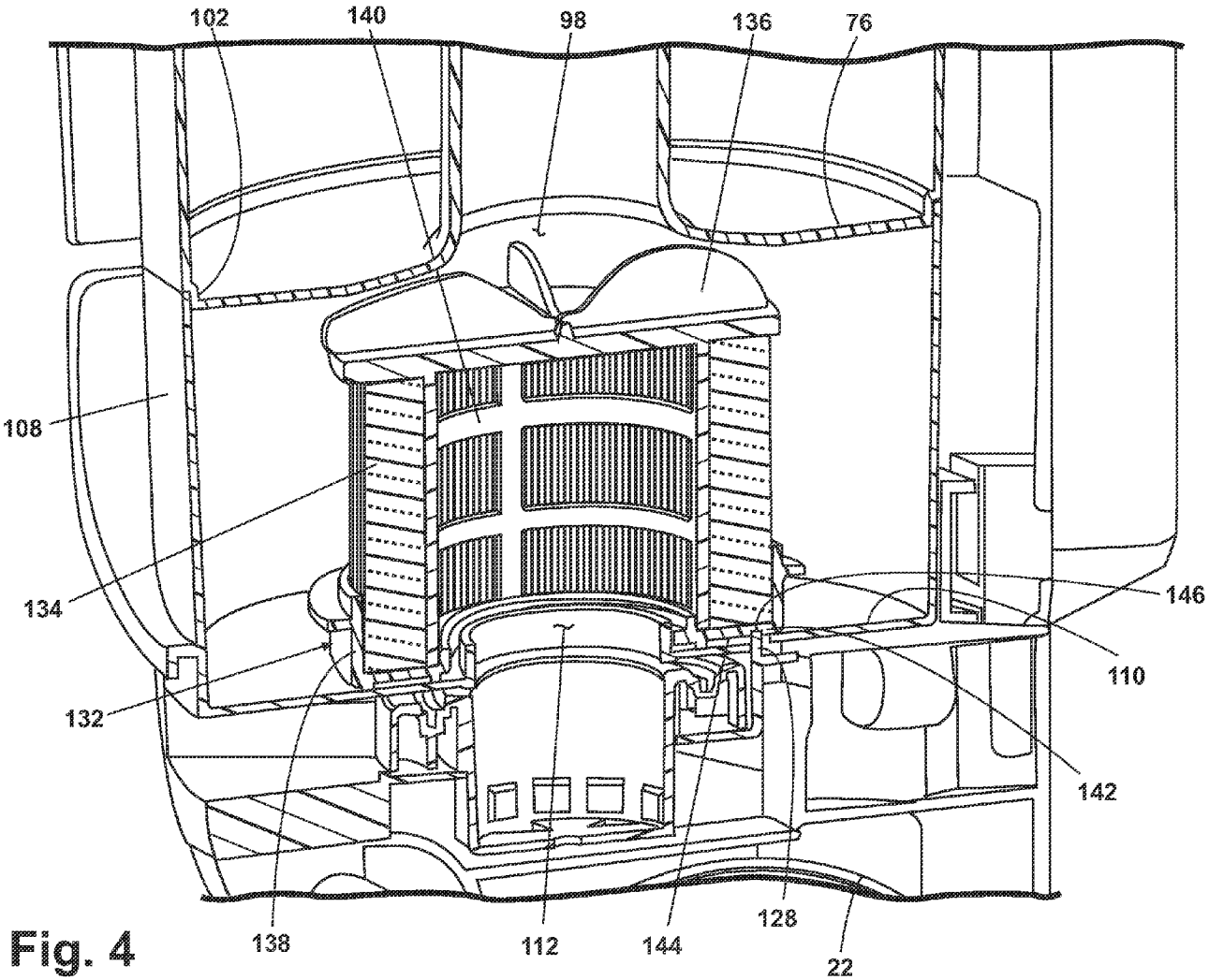
FIG. 4 is a partial cross-sectional view taken along line 4-4 of FIG. 1.

Now referring to FIGS. 3-4, the debris collection container 40 is received within a recess 68 on the main housing 16 below the cyclonic dirt separator 38 and above the filter chamber 42. The debris collection container 40 is generally defined by a cylindrical housing 70 having an open top 72, a cylindrical outer sidewall 74, and a bottom wall 76 with an exhaust aperture 78 (FIG. 2). A handle 80 is formed on the sidewall 74 at a forward portion thereof. The debris collection container 40 and filter chamber 42 are vertically adjustable relative to the cyclonic dirt separator 38 by a cam mechanism 82 so that the debris collection container 40 and filter chamber 42 can be raised into an engaged and operative position with the cyclonic dirt separator 38. The upper edge 84 of the sidewall 74 is received within an offset lower lip 50 of the separator housing 44 thereby preventing the debris collection container 40 from becoming dislodged from the cyclonic dirt separator 38.

A resilient seal 86 is retained within a groove 88 (FIG. 2) in the offset lower lip 50. The resilient seal 86 (FIG. 2) is compressed by the upper edge 84 of the debris collection container 40 when the debris collection container 40 is raised to its use position. A hollow cylindrical standpipe 90 protrudes upwardly from the exhaust aperture 78 thereby forming a conduit 92 (FIG. 2) to guide the exhaust airstream flowing through the exhaust grill 56 into the filter chamber 42. The upper end 94 of the standpipe 90 is configured to sealingly mate to a lower surface of the central outlet aperture 66 in the separator plate 60. A gasket 96 (FIG. 2) is positioned between the outlet aperture 66 and the upper end 94 of the standpipe 90 to minimize leakage. The bottom 98 of the standpipe 90 comprises the exhaust aperture 78 that is in fluid communication with the filter chamber 42.

The debris collection container 40 can further comprise any combination of upstanding prongs or fingers (not shown) projecting upwardly from the bottom wall 76, vertical fins (not shown) projecting inwardly from the sidewall 74, and/or intermittently spaced helical fins 100 protruding from the sidewall 74. These finger and fin features help minimize re-entrainment of dirt in the cyclonic airflow and promote agglomeration of the dirt in the debris collection container 40. These features are more fully described in U.S. Application Publication No. 20070084158 and U.S. Application Ser. No. 61/058,995, which are incorporated herein by reference in their entirety. The stepped lower wall 102 of the debris collection container 40 is configured to nest within a top opening 104 of a cylindrical filter housing 106 although the filter housing 106 can be of any size and shape to conveniently fit in the recess 68. Furthermore, any of the outer walls of the filter housing 106 can be made of transparent material to permit the user direct visibility of a pre-motor filter element 134 as more fully disclosed herein. The fit between the bottom of the debris collection container 40 and the filter housing top opening 104 is configured to minimize air leakage when the components are in their respective in-use positions.

With continued reference to FIGS. 3-4, the filter housing 106 is mounted below the debris collection container 40 and has a top opening 104 in fluid communication with the standpipe exhaust aperture 78. The filter housing 106 is defined by generally cylindrical sidewalls 108, a top opening 104, and a bottom wall 110 having a centrally located exhaust aperture 112 configured to receive a removably mounted filter assembly 114. A U-shaped handle 116 is also provided on a front-facing portion of the sidewall 108 to facilitate removal and installation by a user. The filter assembly 114 mates with the bottom wall 110 via a ¼ turn bayonet fastener, although other commonly known mechanical fastening means are contemplated such as threads, detents, or other commonly known fastening methods. Indentations 118 formed in the sidewalls 108 of the filter housing 106 are configured to provide clearance to mounting protrusions 120 that extend inwardly from the sides of the main housing 16. This clearance between the mating parts is required during removal and installation of the filter housing 106 to the main housing 16. Each indentation 118 further comprises a recessed retainer pocket 122 formed at an upper portion and extending upwardly along an end wall 123 of each indentation 118. Each retainer pocket 122 receives an upper portion 124 of the corresponding mounting protrusion 120 to guide and retain the filter housing 106 on the main housing 16 along a longitudinal axis relative to the filter housing 106.

The bottom wall 110 of the filter housing 106 further comprises a slot 126 adjacent to the exhaust aperture 112. The slot 126 is positioned to receive a small locking rib 128 that protrudes upwardly therethrough from a motor housing 148 below the filter housing 106. The preferred locking rib 128 is about 0.25 inches wide and 0.25 inches tall; however, this dimension can vary from about 0.10 to about 1.00 inches. Other locking rib 128 configurations are contemplated such as incorporating a plurality of spaced locking ribs 128 and alternate shapes such as cylindrical posts, T-shaped ribs, and the like. The locking rib 128 protrudes through the bottom wall 110 of the filter housing 106 to a height sufficient for engaging a filter frame 132 mounted thereto.

The filter assembly 114 comprises a filter frame 132, which supports a cylindrical filter element 134. The filter frame 132 comprises a top 136, a bottom 138, and a cylindrical cage 140 portion. The cylindrical filter element 134 can comprise open cell foam, pleated HEPA or ULPA filter media, non-woven materials, or any suitable combination thereof. The filter assembly 114 is configured to engage the bottom wall 110 of the filter housing 106 via a ¼ turn bayonet fastener or any other suitable mechanical fastening means.

Recessed pockets 142 are formed in the bottom face 144 of the filter frame 132. The pockets 142 are configured to receive the upper end 146 of the locking rib 128 that protrudes from the motor housing 148 through the bottom wall 110 of the filter housing 106. Three pockets 142 are included on the bottom face 144, but the quantity can be increased or decreased depending on the number of possible filter frame 132 mounting orientations.

When the filter assembly 114 is mounted to the filter housing 106 and the filter housing 106 is installed onto the main housing 16, the locking rib 128 protrudes through the slot 126 in the filter housing 106 and engages a pocket 142 on the filter frame 132. The mechanical engagement between the locking rib 128 and the pocket 142 prevents rotation of the filter assembly 114, thereby preventing removal of the filter assembly 114 from the filter housing 106 while said filter housing 106 is seated on the main housing 16. To remove the filter assembly 114, the pocket 142 is disengaged from the locking rib 128 by first removing the filter housing 106 from the main housing 16.

In operation, the fan/motor assembly 22 is positioned downstream from the exhaust aperture 112 in the filter housing 106 such that when energized, it establishes and maintains a dirt-containing airstream from the suction nozzle 32 to the cyclonic dirt separator 38. The fan/motor assembly 22 draws air from the suction nozzle 32 to the tangential inlet 52 and into the cyclonic dirt separator 38 where the dirty air swirls around the separation chamber 61. Dirt and debris fall through debris outlet 64 into the debris collection container 40. The working air flow then passes through the louvers 62 of the exhaust grill 56 and enters the conduit 92 formed by the standpipe 90 where it proceeds into the filter housing 106.

The working air then proceeds through a filter assembly 114 where any remaining small dust particles are trapped by the filter element 134. The filter element 134 removes fine particles from the airstream that passes from the cyclonic separation chamber 61 through the standpipe 90, and into the fan/motor assembly 22. The working air then continues on to an inlet (not shown) of the fan/motor assembly 22. After passing through the fan/motor assembly 22, the exhaust air may, optionally, pass from an outlet opening of the fan/motor assembly 22 through a final exhaust filter 150 before re-entering the atmosphere through an outlet port that can be formed by a plurality of motor exhaust louvers 152.

To dispose of collected dirt and debris, the debris collection container 40 is detached from the cyclonic dirt separator 38 by actuating a cam mechanism 82 to lower the debris collection container 40 and filter housing 106. Once disengaged from the offset lip 24, the debris collection container 40 can be lifted out of the filter housing top opening 104 and removed from the main housing 16. Dirt and debris disposal is accomplished by inverting the debris collection container 40.

Once the debris collection container 40 is removed from the main housing 16 the filter assembly 114 is directly visible to a user. The visibility of the filter assembly 114 increases the chances that a user will notice a clogged filter element 134 and will subsequently clean or replace the filter assembly 114. Thus, the direct visibility of the filter assembly 114 can lead to more frequent filter assembly 114 maintenance, which in turn helps ensure efficient operation of the vacuum cleaner 10.

Thus, upon removal of the debris collection container 40, access to the filter housing 106 is provided such that a user can optionally remove the filter housing 106 and replace or clean the filter assembly 114 mounted thereto. The interface between the locking rib 128 and the slot 126 prevents a user from removing the filter assembly 114 while the filter housing 106 is mounted to the main housing 16 and inadvertently operating the vacuum cleaner 10 while the filter assembly 114 is removed. To remove the filter housing 106, the user lifts the filter housing 106 upwardly until the retainer pockets 122 on the sides of the filter housing 106 clear the mounting protrusions 120 on the main housing 16. As the filter housing 106 is lifted, the mating pocket 142 in the bottom face 144 of the filter frame 132 disengages the locking rib 128 protruding from the motor housing 148. The user can then remove the filter housing 106 from the main housing 16 and subsequently detach the filter assembly 114 from the filter housing 106. Reinstallation of the filter assembly 114, filter housing 106, and debris collection container 40 occurs in the reverse order to again prepare the vacuum cleaner 10 for operation.

While the invention has been specifically described in connection with certain specific embodiments thereof, it is to be understood that this is by way of illustration and not of limitation. It is anticipated that the features described can be applied to any vacuum cleaning device utilizing conventional clean air filter bags, or cyclone separation device utilizing a single cyclone, or two or more cyclones arranged in any combination of series or parallel airflows. Whereas the invention has been described with respect to an upright vacuum cleaner, the invention can also be used with other forms of vacuum cleaners, such as canister or central vacuum cleaners. Reasonable variation and modification are possible within the scope of the forgoing disclosure and drawings without departing from the spirit of the invention, which is defined in the appended claims.

What is claimed is:

1. A vacuum cleaner comprising:

a main housing having a suction cavity and a motor housing;

a dirt separator removably mounted in the suction cavity and having a separation chamber having an inlet opening and an outlet opening;

a vacuum fan/motor mounted in the motor housing of the main housing and having a suction inlet in communication with the dirt separator outlet opening and adapted to maintain a flow of dirty air through the separation chamber between the inlet opening and the outlet opening;

a filter housing removably mounted in the main housing between the dirt separator outlet opening and the suction inlet of the vacuum fan/motor;

a filter assembly removably mounted in the filter housing; and an interlock between the filter assembly, the filter housing and the main housing and comprising a locking rib fixed on the main housing that is adapted to prevent removal of the filter assembly from the filter housing prior to removal of the filter housing from the main housing.

2. The vacuum cleaner of claim 1, wherein the locking rib is fixed on the motor housing and configured to be selectively received in a corresponding slot in the filter housing when the filter housing is positioned adjacent the motor housing and coupled to a portion of the filter assembly to prevent removal of the filter assembly when the filter housing is seated in the main housing.

3. The vacuum cleaner of claim 1 further comprising a debris collection container removably coupled to the separation chamber and adapted to receive debris separated from air in the separation chamber.

4. The vacuum cleaner of claim 3 further comprising a debris outlet at an upper portion of the separation chamber through which debris may enter the debris collection container.

5. The vacuum cleaner of claim 3 further comprising a cam mechanism beneath the filter housing for raising and lowering the filter housing and the debris collection container with respect to the separation chamber whereby the debris collection container is in a first position in contact with the separation chamber and in a second position separated from the separation chamber for removal of the debris collection container.

6. The vacuum cleaner of claim 3, wherein the debris collection container is removable from the main housing independent of the filter housing and the debris collection container is directly adjacent the filter housing and the filter assembly is configured within the filter housing so that the filter assembly is exposed for removal when the debris collection container is removed from the main housing.

7. The vacuum cleaner of claim 1, wherein the dirt separator is a cyclonic dirt separator.

8. The vacuum cleaner of claim 1, wherein the interlock further comprises:

a first locking rib receiver provided on the filter assembly; and a second locking rib receiver provided on the filter housing;

wherein the a locking rib is adapted to be removably retained in the first and second locking rib receivers when the filter assembly is mounted in the filter housing and the filter housing is mounted in the main housing.

9. The vacuum cleaner of claim 8, wherein the first locking rib receiver comprises a recessed pocket in the filter assembly.

10. The vacuum cleaner of claim 9, wherein the second locking rib receiver comprises a slot in the filter housing that is aligned with the recessed pocket when the filter assembly is mounted in the filter housing.

11. The vacuum cleaner of claim 9, wherein the filter assembly comprises a filter frame removably mounted in the filter housing, the frame comprising the first locking rib receiver and a cavity that receives a filter.

12. A vacuum cleaner comprising:

a main housing having a suction cavity and a motor housing;

a dirt separator removably mounted in the suction cavity and having a separation chamber having an inlet opening and an outlet opening;

a vacuum fan/motor mounted in the motor housing of the main housing and having a suction inlet in communication with the dirt separator outlet opening and adapted to maintain a flow of dirty air through the separation chamber between the inlet opening and the outlet opening;

a filter housing removably mounted in the main housing between the dirt separator outlet opening and the suction inlet of the vacuum fan/motor;

a filter assembly removably mounted in the filter housing;

the improvement comprising:

an interlock between the filter assembly, the filter housing and the main, housing to prevent removal of the filter assembly from the filter housing prior to removal of the filter housing from the main housing;

wherein the filter assembly is configured to be fastened to a bottom wall of the filter housing via the interlock.

13. The vacuum cleaner of claim 12, wherein the interlock is a rotatable bayonet fastener.

14. The vacuum cleaner of claim 12, wherein the interlock is a threaded fastener.

15. The vacuum cleaner of claim 12, wherein the filter assembly comprises a filter frame that includes at least one recessed pocket and a cavity that receives a filter, and wherein the main housing comprises at least one locking rib that is adapted to be removably retained in the recessed pocket.

16. The vacuum cleaner of claim 15, wherein the at least one locking rib is an upright post.

17. The vacuum cleaner of claim 15, wherein the at least one locking rib is a T-shaped rib.

18. The vacuum cleaner of claim 15, wherein the recessed pocket and locking rib comprises an interlocking connection that is adapted to preclude relative rotation between the filter assembly and the filter housing when the filter assembly and the filter housing are mounted in the suction cavity.

19. The vacuum cleaner of claim 18, wherein the filter housing comprises a slot through which the locking rib extends when the filter assembly is assembled in the filter housing, whereby a user must remove the filter housing and filter assembly from the suction cavity prior to removal of the filter assembly from the filter housing.

20. The vacuum cleaner of claim 19, wherein the locking rib interfaces with the filter assembly and the motor housing to prevent rotation of the filter assembly with respect to the filter housing.

* * * * *